United States Patent [19]

Olkoski et al.

[11] Patent Number: 4,993,280

[45] Date of Patent: Feb. 19, 1991

[54] ROTATIONAL CONTROL ASSEMBLY

[75] Inventors: Jill C. Olkoski, Ft. Lauderdale; Mark S. Bresin, Coral Springs; John F. Murray, Sunrise, all of Fla.

[73] Assignee: Motorola, Inc., Schaumburg, Ill.

[21] Appl. No.: 380,245

[22] Filed: Jul. 17, 1989

[51] Int. Cl.[5] ..... G05G 1/10

[52] U.S. Cl. ..... 74/553; 74/10 R

[58] Field of Search ..... 74/553, 10 R

[56] References Cited

U.S. PATENT DOCUMENTS

| | | | |
|---|---|---|---|
| 2,154,537 | 4/1939 | Stenberg | 74/553 |
| 2,502,915 | 4/1950 | Atkins et al. | 74/553 |
| 3,473,408 | 10/1969 | Bettinger | 74/553 |
| 3,767,880 | 10/1973 | Austin | 74/553 |
| 4,197,765 | 4/1980 | Shimoda | 74/553 |
| 4,295,246 | 10/1981 | Howie, Jr. | 74/553 |
| 4,433,218 | 2/1984 | Provencher | 74/553 |

*Primary Examiner*—Leslie A. Braun
*Assistant Examiner*—Winnie Yip
*Attorney, Agent, or Firm*—Robert S. Babayi

[57] ABSTRACT

A mechanical rotational control assembly (100) is provided having a knob (20) engaged to a potentiometer's rotating shaft (55). A friction element (40), such as a washer made of a material having similar temperature characteristics to the knob (20), is interlocked to the stationary portion (57) of the potentiometer. The peripheral boundary (47) of the friction element (40) is engaged to the skirt portion (25) of the knob (20), so as to produce a fricional force when the knob (20) is rotated, and thereby increasing the rotational torque of the rotational control assembly.

11 Claims, 2 Drawing Sheets

ROTATIONAL CONTROL ASSEMBLY

TECHNICAL FIELD

This invention relates generally to the field of rotary actuated controls, especially those controls having a torque element for increasing the rotational torque.

BACKGROUND ART

The adjustment of the audio level in many electronic devices, which are capable of producing audio, such as a portable two-way radio, is achieved by rotating a knob. Generally, the knob is engaged to a rotating shaft of a potentiometer, and rotating the knob increases or decreases the audio power delivered to a speaker. The amount of control one has in setting a desired audio level is proportional to the rotational torque required to rotate the shaft. A lower rotational torque provides less control, while a higher rotational torque provides more control over audio adjustments. A low rotational torque may cause problems in maintaining the desired audio setting, and may easily cause inadvertent rotation of the knob. Therefore, it is desirable to increase the rotational torque of a rotational control assembly.

One approach to increase the rotational torque comprises incorporating a means to increase the rotational torque of the potentiometer itself. This approach, however, is costly, and reduces the life cycle of the potentiometer. Another approach, which is particularly used in two-way portable radio's manufactured by Motorola Inc., comprises inserting a friction causing element, such as a rubber washer, between the bottom surface of the knob and the escutcheon of the radio. This approach causes difficulty in assembly, and large variations in the process. This is because downward pressure must be exerted on the knob, and a set screw must be tightened to adjust the rotational torque of each radio individually.

SUMMARY OF THE INVENTION

Accordingly, it is an object of the present invention to provide a cost effective, simpler, and more reliable means for increasing the rotational torque of a rotational control assembly.

Briefly, according to the invention, a rotational control assembly is provided, which includes a knob, a control element, and a frictional element. The knob has a hollow interior, which includes a skirt portion. The control element has a rotating shaft engaged to the inner walls of the knob. The friction element is locked to the control element, and its peripheral boundary engages the skirt portion of the knob. The frictional force produced by rotating the knob increases the rotational torque of the control assembly.

DETAILED DESCRIPTION OF THE PREFERRED EMBODIMENT

Figure 1:
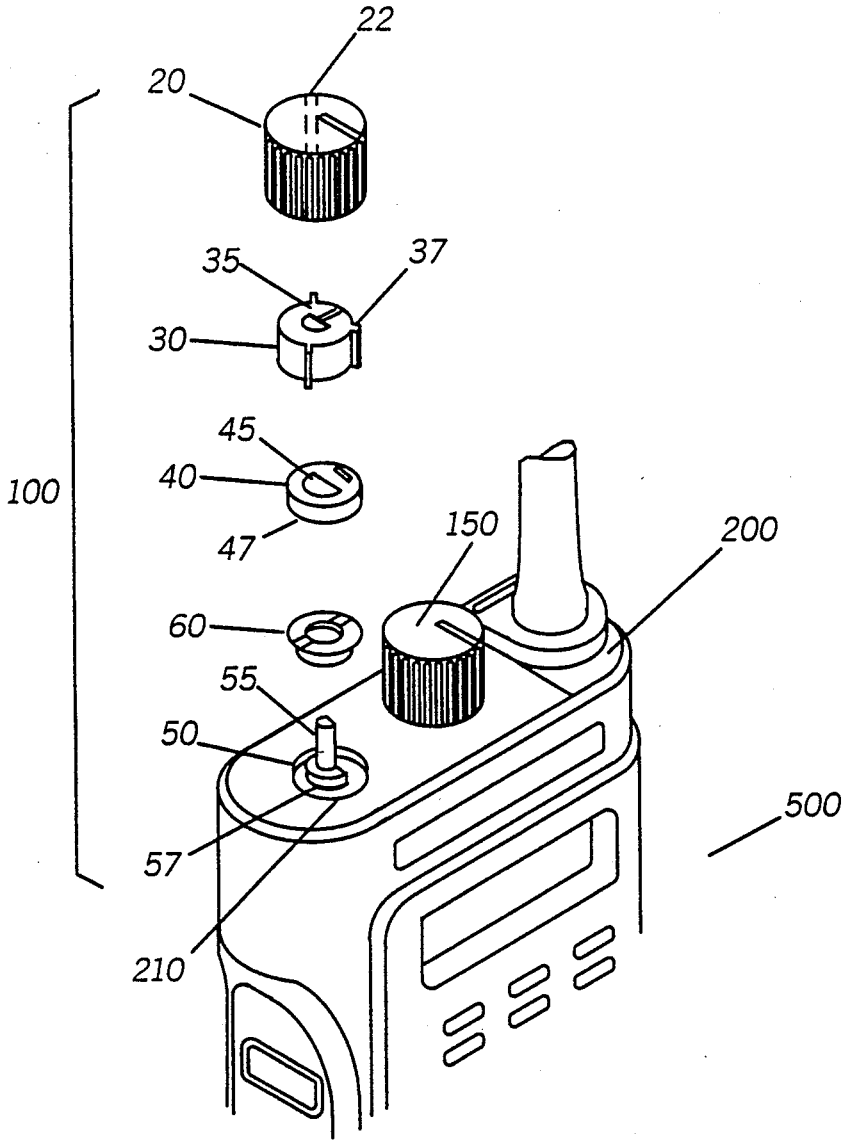
FIG. 1 is an isometric view of the rotational control assembly according to the present invention.

Referring to FIG. 1, a housing assembly 200, and a rotational control assembly 100, which may be a part of a two-way portable radio 500 are shown. The preferred rotational control assembly 100 includes a control element 50, which may be a potentiometer for controlling the audio level of the radio 500. The control element 50, through a round opening 210, is fastened to the housing assembly by a spanner nut 60. The potentiometer includes a rotary shaft 55 and a stationary portion 57 each having a D-shaped horizontal cross section. A round friction element 40, which may be a washer having a D-shaped opening 45 in the middle and a peripheral boundary 47, is snapped onto the stationary portion 57 of the control element 50. This friction element is preferably made of polycarbonate material.

Figure 2:
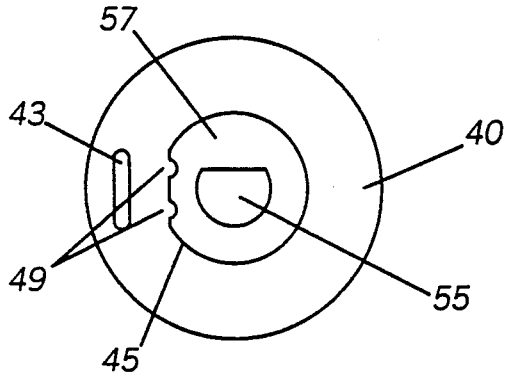
FIG. 2 is a top cross sectional view of the control element and friction element subassembly.

Referring to FIG. 2, the top cross section of the control element 50, and the friction element 40 after being snapped to each other is shown. The flat side of the D-shaped opening 45 includes two notches 49, which in association with an oval opening 43 provide the snapping mechanism. The oval shaped opening, positioned on the rear portion of the flat side of the D-shaped opening 45, provides the flexing required to secure a tight engagement between the control element 50 and the friction element 40.

Referring back to FIG. 1, a cylindrical insert 30, preferably made of plastic material, having a D-shaped opening is aligned with, and inserted onto the D-shaped shaft 55. The outer surface of the insert 30 includes outwardly extended vertical tabs 37. A cylindrical hollow knob 20 preferably made of plastic material, such as thermoplastic urethane, is inserted downwardly onto the insert 30 in such a manner that the tabs 37 of the insert 30 are aligned and engaged to corresponding grooves 22 located on the inner walls of the knobs. When it is fully inserted onto the insert 30, the knob 20 covers the insert 30, and makes substantial contact with the peripheral boundary 47 of the friction element 40. This mechanism allows for the rotation of the shaft 55, when the knob 20 is rotated.

Figure 3:
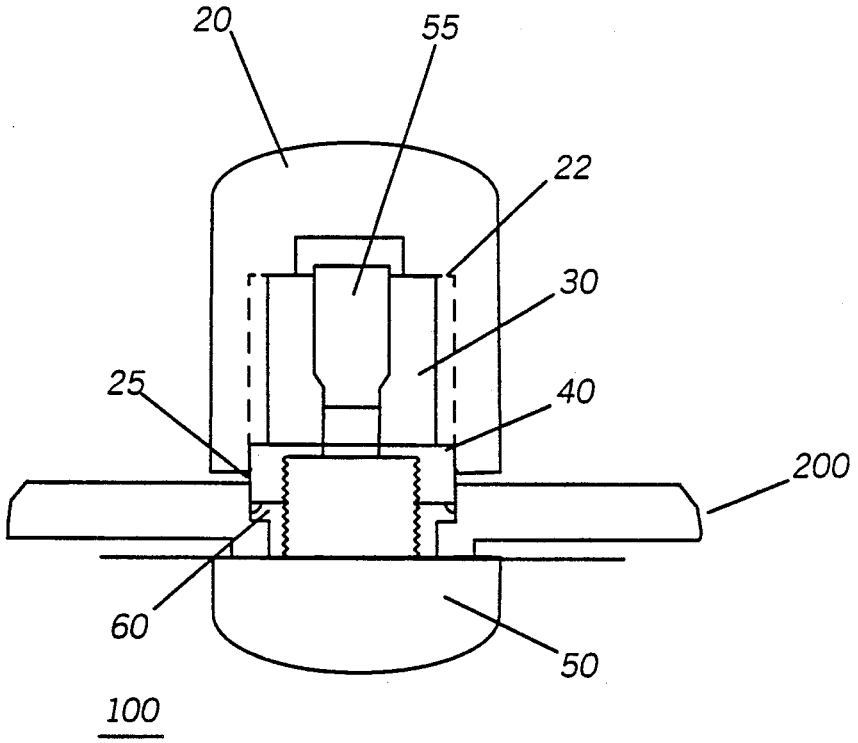
FIG. 3 is a side cross sectional view of the assembled rotational control assembly according to the present invention.

Referring to FIG. 3, a side cross sectional view of the assembled rotational control assembly 100, and the housing 200 is shown. The hollow interior of the knob 20, includes a skirt portion 25, having a diameter substantially equal to the diameter of the friction element 40. This produces a substantially tight fit between the frictional element 40's peripheral boundary 47 (shown in FIG. 1), and the skirt portion 25 of the knob 20. When the knob is rotated, the frictional forces produced between the peripheral boundary 47 of the friction element 47, and the skirt portion 25 of the knob 20, increases the rotational torque of the rotational control assembly 100.

The expansion and/or contraction rate of the materials, due to temperature variation, may affect the rotational torque of the rotational control assembly 100. A non-uniform expansion and/or contraction rate may substantially increase and/or decrease the rotational torque of the rotational control assembly 100 under various temperature conditions. Substantial testing has proved that the temperature characteristic of the preferred materials thermoplastic urethane used for the knob 20, and polycarbonate used for the friction element 40, provide a substantially uniform expansion and/or contraction rate.

Referring back to FIG. 1, another preferred embodiment of the present invention is shown. A rotary frequency switch 150, which is used for selecting the reception and transmission channels of the radio 500 may utilize the approach described in association with the rotational control assembly 100 to increase the rotational torque of the frequency switch 150.

The implementation of the invention as described above while being reliable, reduces the cost associated with increasing the rotational torque, and provides a much simpler assembly steps. Another advantage achieved by this invention is that the friction element 30 provides a self sealing means for the rotational control assembly 100, which maintains contacting surfaces free of dust and other harmful and abrasive particles.

What is claimed is:

1. A rotary control assembly, comprising:

a hollow knob having an interior portion;

a control element having a rotary shaft, said rotary shaft being locked to said knob;

a friction element having a peripheral boundary, said friction element being locked to said control element;

said interior portion of said knob is frictionally engaged to said peripheral boundary of said friction element such that rotational torque of said rotary control assembly is increased when the knob is rotated.

2. The assembly of claim 1, wherein said control element is a rotary potentiometer.

3. The assembly of claim 1, wherein said control element is a rotary switch.

4. The assembly of claim 1, wherein said knob being made of thermoplastic urethane.

5. The assembly of claim 1, wherein said friction element being made of polycarbonate.

6. A housing assembly, comprising:

a housing member having an opening;

a control element fastened to said housing assembly through said opening; said control element having a rotary shaft;

a hollow knob having an interior portion is locked to said rotary shaft;

a friction element having a peripheral boundary is locked to said control element;

said interior portion of said knob is frictionally engaged to said peripheral boundary of said friction element such rotational torque of said housing is increased when the knob is rotated.

7. The housing assembly of claim 6, wherein said control element is a rotary switch.

8. The housing assembly of claim 6, wherein said knob being made of thermoplastic urethane.

9. The housing assembly of claim 6, wherein said friction element being made of polycarbonate.

10. The housing assembly of claim 6, wherein said housing assembly is a part of a radio.

11. The housing assembly of claim 6, wherein said control element is a rotary potentiometer.

* * * * *